US005441272A

United States Patent [19]

Artola

[11] Patent Number: 5,441,272

[45] Date of Patent: Aug. 15, 1995

[54] PUTTER WITH GUIDE FIN OR MARK

[75] Inventor: Felipe U. Artola, Bizkaia, Spain

[73] Assignee: Masker, S.A., Las Arenas-Gexto, Spain

[21] Appl. No.: 184,216

[22] Filed: Jan. 21, 1994

[30] Foreign Application Priority Data

Jan. 21, 1993 [ES] Spain ..... 93 00104

[51] Int. Cl.[6] ..... A63B 53/00; A63B 69/36

[52] U.S. Cl. ..... 273/187.4; 273/194 A

[58] Field of Search ..... 273/186.2, 187.4, 183.1, 273/35 R, 194 R, 194 A

[56] References Cited

U.S. PATENT DOCUMENTS

| | | | |
|---|---|---|---|
| 2,934,347 | 4/1960 | Siniscalchi | 273/164 |
| 3,384,376 | 5/1968 | Greenlee | 273/194.4 |
| 3,667,761 | 6/1972 | Palotsee | 273/187.4 |
| 3,866,922 | 2/1975 | Marci et al. | 273/164 |
| 3,880,430 | 4/1975 | McCabe | 273/187.4 |
| 3,917,277 | 11/1975 | Beck et al. | 273/163 R |
| 4,128,244 | 12/1978 | Duclos | 273/164 |
| 4,209,172 | 6/1980 | Yamamoto | 273/164 X |
| 4,291,883 | 9/1981 | Smart et al. | 273/163 R |
| 4,367,877 | 1/1983 | Gibson et al. | 273/187.4 X |
| 4,550,914 | 11/1985 | McCallister | 273/183 D |
| 4,647,045 | 3/1987 | Bilyeu | 273/194 R X |
| 4,708,346 | 11/1987 | Pierce et al. | 273/187.4 X |
| 4,921,660 | 5/1990 | Kryter | 273/194 A X |
| 5,052,690 | 10/1991 | Sharp | 273/187.4 |
| 5,125,664 | 6/1992 | Evans | 273/164 X |
| 5,135,229 | 8/1992 | Archer | 273/186.2 |
| 5,160,142 | 11/1992 | Marshall | 273/186.2 |

*Primary Examiner*—William H. Grieb

*Attorney, Agent, or Firm*—Browdy and Neimark

[57] ABSTRACT

A putter with a ball-striking face and a rear portion in relation-to this face, which has a fin on the rear face which is inclined with regard to the line between ball and hole in such a way that the direction of some of its edges indicates the trajectory to be followed in the backswing through the inside area in relation to the position of the player. The fin can be replaced by an obvious, clear mark made on the putter in the appropriate direction.

8 Claims, 3 Drawing Sheets

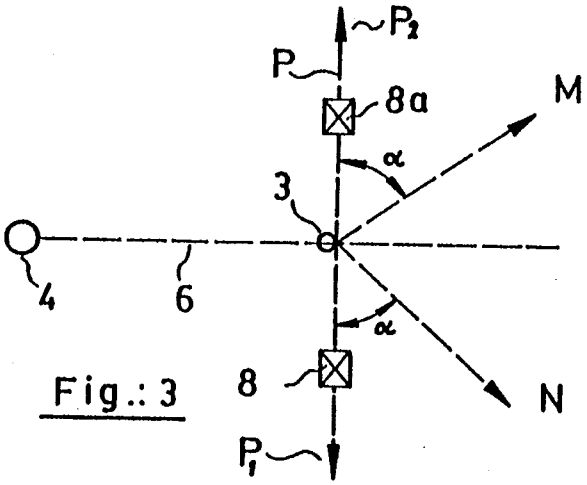
Fig.: 3
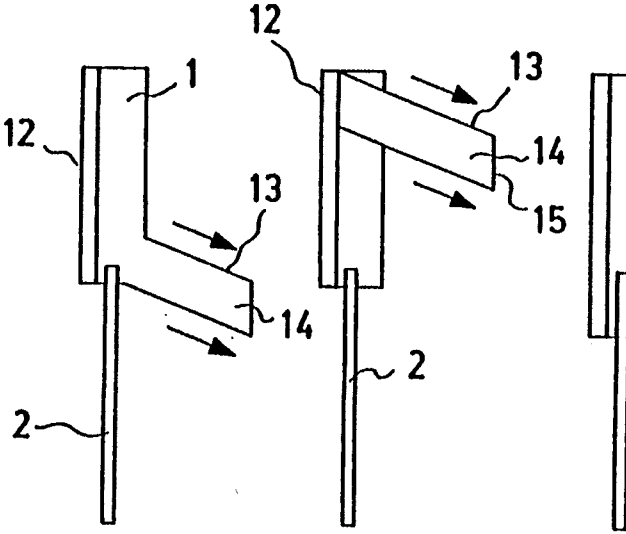
Fig.: 4
Fig.: 5
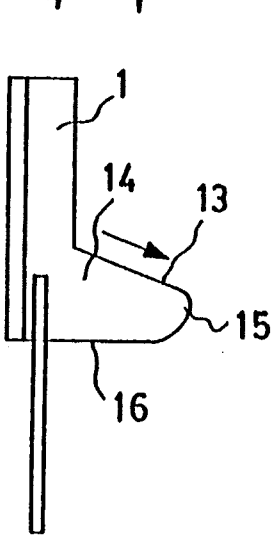
Fig.: 6
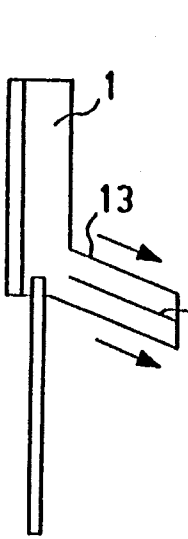
Fig.: 7
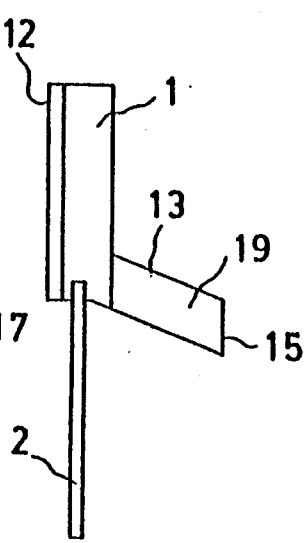
Fig.: 8

PUTTER WITH GUIDE FIN OR MARK

BACKGROUND OF THE INVENTION

1. Technical Field

This invention relates to golf clubs, and more specifically to those known as "putters" used for putting on the green.

2. Prior Art

A stroke habitually used by golfers is the movement consisting of displacing the club, in this case the putter, rearwards from its initial position near the ball, and prior to striking the ball, in a movement known as backswing.

When playing or practicing, this movement very often reflects the golfer's inclination to shift the club towards two trajectories or paths in the backswing which are considered incorrect for the proper performance of the stroke against the ball and produces postures and movements in the player which cause faulty strokes as a result. One of these paths is that of the direction between hole and ball, which is perpendicular to the ball-striking face, and the other is that of the direction either inside or outside the direction between ball and hole in relation to the position of the player.

In view of the fact that, in order to play the game correctly, the most suitable path for the backswing is that which follows the inside course, i.e. between the hole-ball line and the position of the player. This invention is directed to a putter that makes it easier to steer the backswing according to the more suitable path mentioned.

A type of putter studied with this same aim, described in Spanish Patent No. 8801344- ARTOLA, in which an inclined face is provided rearward of the ball-striking face, so that the path of the backswing is established based on the direction of the putter being perpendicular to the said inclined face. However, in some cases the golfer has certain practical difficulties to follow the said perpendicular path with precision, which sometimes causes inaccuracies in the striking of the ball and consequently in the ball taking the correct direction towards the hole.

OBJECT AND SUMMARY OF THE INVENTION

One basic object of the invention is to provide a putter which gives a greater surety that the club, on the backswing, is going to follow the inside course, towards the player, in such a way that the path of the ball, once it has been struck, follows the ideal direction towards the hole.

In order to achieve the object of the invention, the provision of a mark or a fin is provided, situated behind the ball-striking face of the putter, which might or might not be an integral part of the head of the putter. The fin in question has some of its edges oriented in accordance with a direction that corresponds to the course to be followed by the head during the backswing, in such a way that the direction of the edge or edges forms a variable acute angle in relation to the direction of the heel tip line of the putter.

The fin in question is a perfectly obvious item so that, in the ball striking position, it indicates the trajectory of the putter head on the backswing in a natural way, thus allowing the player to follow this course.

The fin is preferably situated in a horizontal plane so that it can, in itself, indicate the trajectory of the head. However, the surface of the said fin can form a plane different to the horizontal, either upwards or downwards, given that the same visual effect will be perceivable by the player.

Obviously, the fin will be of sufficient size, both in length and in width, to ensure that it is clearly visible.

The fin can occupy any position behind the ball-striking face and can be established starting from any point and in the trajectory required, either in areas close to the tip of the head or close to the heel of the head.

The fin can have the two side edges that form it situated parallel to each other in such a way that between them they form a clearly evident mark for the player. However, the invention also includes the possibility that only one of the said side edges is inclined, being sufficient to achieve the effect sought by the invention.

At least one of the side edges of the fin which performs the function of being a clearly evident mark can be curved in such a way that its curvature resembles the trajectory of the head on the backswing and the whole combines with the other constructive variants stated. , The fin in question can occupy the whole of the rear part of the ball-striking face, exactly as was pointed out earlier, as long as at feast one of its sides is inclined in accordance with the trajectory of the backswing.

The fins can be provided with other evident marks on their surface, which in themselves or in combination with at least one of the sides,, can form the visible sign that the trajectory of the club must follow.

The object of the invention can also be achieved in the same way without the assistance of any fin, by using only at least one mark, protuberance, recess, hollow, . . . etc. in the body of the putter.

BRIEF DESCRIPTION OF THE DRAWINGS

In this respect, and with the aim of acting as a support for the invention, drawings are attached, on which different practical solutions are shown, namely:

FIG. 3 represents a situation of the course lines of the backswing in relation to the line between the ball and the hole.

FIG. 4 shows a first embodiment of the putter according to the invention.

FIG. 5 shows a second embodiment of the putter according to the invention.

FIG. 6 shows a third embodiment of the putter according to the invention.

FIG. 7 shows a fourth embodiment of the putter according to the invention.

FIG. 8 shows a fifth embodiment of the putter according to the invention.

DETAILED DESCRIPTION OF THE PREFERRED EMBODIMENT(S) OF THE INVENTION

Figure 1:
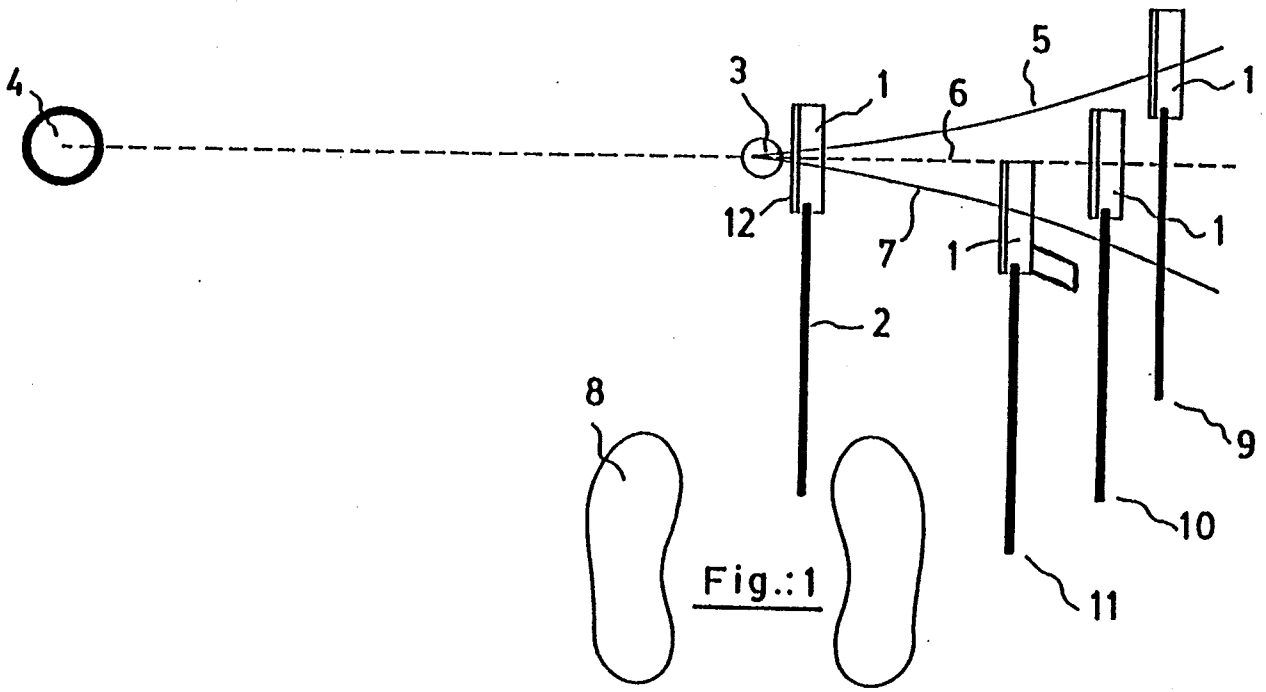
FIG. 1 shows a arrangement of the three possible trajectories of the backswing.

Referring now to FIG. 1 of the drawings, we can appreciate a situation in which the position of a putter (1) is shown, close to the ball (3), and in which the front or forward face (12) has to strike the ball towards the hole (4), with the putter head (1) being operated by means of the golf club shaft (2). The three possible positions of performing the backswing are illustrated here, one of which is indicated by the position (5, 9) and known as "outside" the line between the ball and hole (3, 4) in relation to the position of the player (8).

A second position (6, 10) coincides with the line between ball and hole (3, 4).

A third position (7, 11) is that known as "inside" the line between ball and hole (3, 4) in relation to the position of the player (8), with this being the position for which the invention has been designed.

As has already been mentioned, it is considered that the trajectory (7) produces postures and movements in the player which give better results than the other two trajectories (5) and/or (6).

Figure 2:
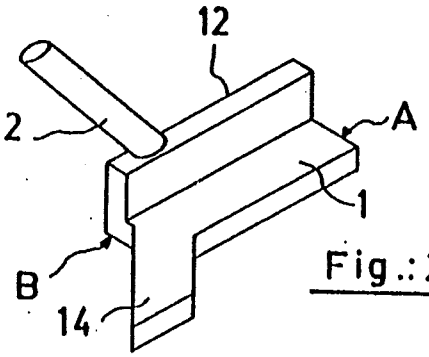
FIG. 2 shows a perspective of a putter with a fin in accordance with the invention.

Referring to FIG. 2, one solution of the invention is shown, according to which a putter (1) is illustrated, provided with the striking face (12) and the shaft (2), as well as the mark, an inclined fin (14) arranged behind the said striking face (12) and with a variable inclination in relation to the tip (A)-heel (B) line of the longitudinal axis itself of the body of the head (1) with this variable inclination always being less than 90°, i.e. an acute angle.

FIG. 3 shows a schematical representation that illustrates the positions of the ball (3) and the hole (4) in the alignment (6), as well as the line (P) that indicates the position of the longitudinal axis of the putter. The positions (8) and (8a) which have been marked on this line correspond to the situations which would be occupied by a right-handed player and a left-handed player, respectively, to strike the ball (3). We can observe here that the direction of the trajectory (N) that the right-handed player would describe, following the line of the mark or fin (14) in FIG. 2, forms an acute angle ($\alpha$) with the direction of the tip-heel line (P1) of the head of the putter.

In the same way, the direction of the trajectory (M) for a left-handed player also forms an acute angle ($\alpha$) with the direction of the tip-heel line (P2) of the head of the putter.

As has been mentioned previously, the clearly obvious mark is of variable inclination, given that in any case its angle will depend on the choice of the player.

In FIG. 4 we can appreciate a putter (1) with its striking face (12) and the shaft (2). The fin (14) in this case is close to the heel, at the start of the shaft (2) and its edges (13), which are parallel, are the indicators of the direction of the backswing trajectory, indicated by the arrows which are not numbered.

The putter in FIG. 5 depicts the fin (14) close to the tip of the head (1), with its edges (13) parallel.

The putter in FIG. 6 shows the fin (14), which in this case only has a clearly obvious mark, determined by the line or edge (13), with the other edge being perpendicular to the striking face and having the front edge (15) of any shape.

The putter in FIG. 7 combines the fin with another mark (17), also clearly obvious, which is substantially parallel to the edges (13).

The putter shown in FIG. 8 has the fin (19) at a lower level than that corresponding to the rear portion of the putter (1) behind the striking face (12).

Figure 9:
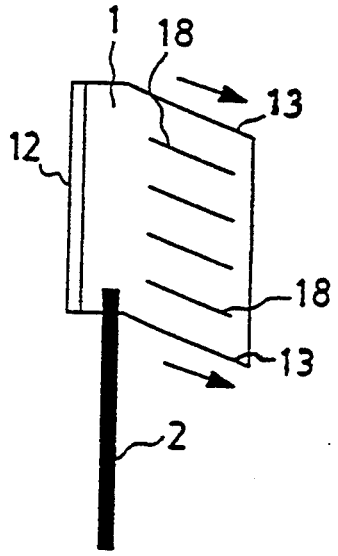
FIG. 9 shows a sixth embodiment of the putter according to the invention.

The putter shown in FIG. 9 depicts a fin which takes in practically all the rear portion of the putter. The edges (13) are parallel, and moreover its surface is provided with another series of marks (18), parallel to each other and also to the edges (13) of the fin.

Figure 10:
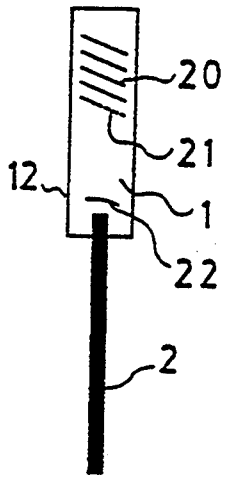
FIG. 10 shows a seventh embodiment of the putter according to the invention.

In accordance with FIG. 10, a variant of the invention is illustrated, according to which the clearly obvious marks can be made on the rear part of the putter, without the need for any kind of fin, but simply based on sufficiently clearly marked lines. These lines or marks can be straight, either continuous (20) or dotted (21), and can even be curved (22) so as to resemble the trajectory of the backswing.

Figure 11:
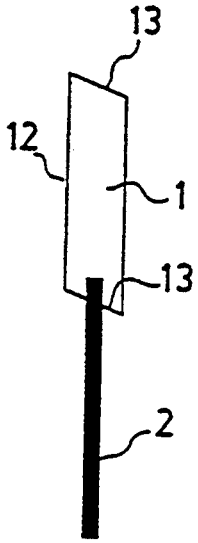
FIG. 11 shows a eighth embodiment of the putter according to the invention.

The putter shown in FIG. 11 is another variant of the invention, in which any kind of putter is provided with edges (13) at its tip and heel ends, which are used to indicate the trajectory.

Figure 12:
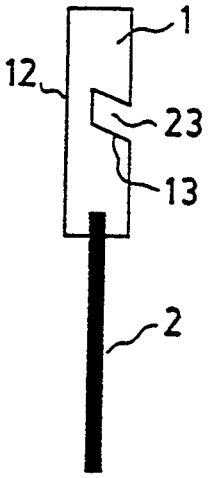
FIG. 12 shows a ninth embodiment of the putter according to the invention.
Figure 13:
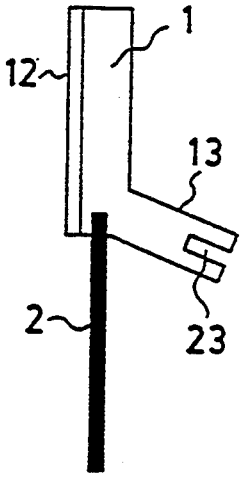
FIG. 13 shows a tenth embodiment of the putter according to the invention.

FIG. 12 represents another variant covered by the invention, in which the clearly obvious mark is formed by a recess (23) whose edges (13) are parallel to each other. In a similar way, the putter shown in FIG. 13 represents a putter with a fin and a recess (23) cut into the fin itself.

Figure 14:
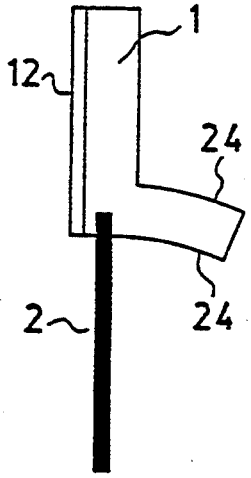
FIG. 14 shows a eleventh embodiment of the putter according to the invention.

The putter illustrated in FIG. 14 shows a rear fin in which the clearly obvious marks are indicated by its set of curved edges (24), which also follow the line of the backswing trajectory.

It is important to emphasize, once having described the nature and advantages of this invention, the non-restrictive nature of the same, inasmuch as changes in the shape, material or dimensions of its constituent parts will not in any way alter its essence, as long as they do not mean a substantial variation of the whole.

I claim:

1. A putter having a putter head and a golf club shaft, said putter head comprising a ball-striking face and a rear portion and a fin protruding from the rear portion, said fin, at least partially, occupying said rear portion, at least one edge of the fin acting as a clearly obvious mark for a player of a direction of a preferred trajectory to be followed by the putter on a backswing, the preferred trajectory being inside the line between ball and an objective, the direction of the at least one edge when the putter head is in a ball striking position being variable and inclined in relation to a longitudinal axis of the golf club shaft, and the at least one edge forming an acute angle with a direction of a tip-heel line of the putter head.

2. A putter, in accordance with claim 1, wherein the fin is made at any height.

3. A putter, in accordance with claim 1, wherein the fin is substantially horizontal when the putter head is in a ball striking position.

4. A putter, in accordance with claim 1, wherein the fin is inclined in relation to the horizontal when the putter head is in a ball striking position.

5. A putter, in accordance with claim 1, wherein the fin has in addition to the edge as a clearly obvious mark, a set of marks parallel to each other and to the said edge.

6. A putter, in accordance with claim 1, wherein the fin has longitudinal edges parallel to each other.

7. A putter, in accordance with claim 1, wherein the fin has a backwardly open recess in a direction parallel to the at least one edge that makes the clearly obvious mark.

8. A putter in accordance with claim 1, wherein the at least one edge of the fin takes the shape of an arc that resembles the preferred trajectory of the backswing.

* * * * *